US006302397B1

(12) United States Patent
Al-Shanfa

(10) Patent No.: US 6,302,397 B1
(45) Date of Patent: Oct. 16, 2001

(54) ELECTION PROCESS CARD GAME, TEACHING AID AND METHOD FOR PLAYING THE SAME

(76) Inventor: Mohammad A. A. R. Al-Shanfa, P.O. Box 2243, Ardiyah, 92400 (KW)

( * ) Notice: Subject to any disclaimer, the term of this patent is extended or adjusted under 35 U.S.C. 154(b) by 0 days.

(21) Appl. No.: 09/664,353

(22) Filed: Sep. 18, 2000

(51) Int. Cl.[7] ..... A63F 1/00

(52) U.S. Cl. ..... 273/292; 273/306; 273/308; 273/257

(58) Field of Search ..... 273/292, 257, 273/306, 308

(56) References Cited

U.S. PATENT DOCUMENTS

| | | | | |
|---|---|---|---|---|
| 3,907,299 | | 9/1975 | Kristen . | |
| 4,085,938 | * | 4/1978 | Bean, Jr. | 273/279 |
| 4,118,036 | * | 10/1978 | Marse | 273/257 |
| 4,216,967 | * | 8/1980 | Marse | 273/257 |
| 4,299,390 | * | 11/1981 | Delgado | 273/257 |
| 4,625,970 | * | 12/1986 | Childs et al. | 273/257 |
| 4,709,926 | * | 12/1987 | DiEgidio | 273/257 |
| 4,807,885 | | 2/1989 | Chamblee et al. . | |
| 4,915,393 | | 4/1990 | Oliver . | |
| 5,190,293 | * | 3/1993 | Cabrera | 273/257 |
| 5,288,076 | * | 2/1994 | Jackson et al. | 273/279 |
| 5,374,066 | * | 12/1994 | Ali | 273/279 |
| 5,660,390 | * | 8/1997 | Ginzburg et al. | 273/257 |

* cited by examiner

*Primary Examiner*—Jeanette Chapman
*Assistant Examiner*—Dolores Collins
(74) *Attorney, Agent, or Firm*—Dougherty & Troxell

(57) ABSTRACT

An election box card game, method for playing the same and teacher's aid are described. The game includes a number of numerical value cards which indicate different numbers of votes and special cards providing for the exchange of cards, false vote cards of no value and one or more game ending cards. A set of rules provides for dealing a number of cards for each player, forming a draw pile, drawing and discarding cards, exchanging cards and playing a game ending card.

10 Claims, 3 Drawing Sheets

ELECTION PROCESS CARD GAME, TEACHING AID AND METHOD FOR PLAYING THE SAME

FIELD OF THE INVENTION

This invention relates to a card game and more particularly to an election process card game and a method for playing the same. It also relates to a teaching aid for illustrating the role of politics in an individuals life.

BACKGROUND FOR THE INVENTION

For many years card games have provided entertainment for adults and children alike. Such games require various levels of skills and often hold and maintain the attention of players for relatively long periods of time. Such games provide not only enjoyment but also an opportunity for people to join together in a social environment. In addition, many such games have an educational value.

A large number of card games are played with a conventional deck of 52 cards which are divided into four suites of 13 cards each. One or two joker cards may be employed in some games. Other games are played with specialized decks to provide added appeal to certain age groups, added excitement and at times to make the game less predictable and/or to reduce the effect of skill on the game.

A U.S. Pat. No. 4,807,885 of Chamblee, et al. discloses a card game which incorporates a series of cards with numerical values and a plurality of specialty or wild cards. As disclosed therein, a selected value, for example, "ninety-nine" form a main part of the game. If playing the game, players discard numerical value cards until the value of the discard is equal to the preselected value. The specialty or wild cards can be played at any time. If a player is unable to discard a card at anytime he or she leaves the game.

Another type of card game which employs specialty cards is disclosed in the U.S. Pat. No. 4,915,393of Oliver. As disclosed therein the game is played with a deck of cards having specialty cards that when played on a penalty card, either transfer the penalty card to a succeeding player, return the penalty to a preceding player or cancel the penalty.

The aforesaid games utilize specialized cards, but do not relate to the election process wherein individuals vote for a candidate. Therefore they do not have educational value with respect to the election of government officials. Accordingly, it is presently believed that there may be a relatively large demand for a card game that utilizes a specialized deck that relates to the election process.

Advantageously, an election process card game and method for playing the same in accordance with the present invention provide entertainment for players of various age groups. In addition, the game and method according to the present invention provide valuable educational content and limited insight into the election of candidates for government offices when the election is based on the votes of the populous. The games and methods also provide the basis for individuals to join together and socialize. They also provide a game with a high degree of unpredictability which adds excitement to the game. The games and methods in accordance with the present invention are believed to have special appeal to younger players since the outcome is relatively unaffected by skill.

Therefore it is presently believed that playing the election process card game disclosed herein will lead to more social interaction and discussion particularly in the election field and the role of politics in an individuals life. Accordingly, it is believed that the election process card game and method disclosed herein may have considerable value as a teaching aid. Furthermore, such games and methods should have particular appeal during periods of local, regional or national elections of government officials.

BRIEF SUMMARY OF THE INVENTION

In essence the present invention contemplates a method for playing an election process card game which incorporates a series of numerical value cards each of which indicate a number of votes in an election process. The card game also incorporates a number of special cards which include one or more change cards and at least one game ending card. In a preferred embodiment of the invention, the card game also incorporates a number of false vote cards which have no value. Such cards are indicative of fraudulent votes which are not counted in a properly conducted election.

The method for playing the election process card game includes the step of dealing a predetermined number of cards to each of a plurality of players in a conventional manner. Then after dealing the cards, the remaining cards are placed in a stack which forms a draw pile. The game commences when a first player as for example the dealer or the player to the dealer's left or right discards a card preferably face down and then draws a replacement card. Then the players follow this procedure sequentially in either a clockwise or counterclockwise order as their playing turn comes around. A single change card may be played during a players normal turn by discarding the change card face up plus the number of cards indicated on a change card face down. The player then draws the same number of cards from the draw pile. Play then continues to the next player.

The game ending card may be played by any player holding a card as their playing turn comes around. This step is analogous to a prime minister or the like calling for an election. Playing the game ending card ends a round of play and each player displays the cards in their hands, preferably categorizing the cards into piles of similar values and each individuals number of votes are tallied. The individual with the most votes wins while the one with the next highest score is the runner-up for that particular round.

In a preferred embodiment of the invention, multiple rounds are played. For example seven rounds or some other preselected number of rounds will be agreed to at the commencement of the game. Then the scores for each round are added together to determine the overall winner and runner-up.

The invention also contemplates a teachers aid comprising a series of numerical value cards wherein each of the numerical value cards correspond to a number of votes in an election. The teachers aid also includes a number of special cards including one or more change cards which indicate a number of cards to be exchanged, a plurality of false vote cards having no numerical value and at least one and preferably two game ending cards. In addition, the aid includes a set of rules.

The rules provide for dealing a predetermined number of cards to each of the plurality of players and providing a draw pile made up of the remaining cards face down. The rules also provide for a sequence of play such as clockwise beginning with the player to the left of the dealer. Under the rules, each player sequentially discards a card face down on a discard pile and then draws a replacement from the draw pile as their playing turn comes around.

The rules also provide for the playing of a change card during a players normal turn. The change card is discarded face up and the number of cards one, two, three, or four are discarded face down and the same number of cards drawn from the draw pile. The game is ended when one of the players during their normal turn discards the game ending card. At this point the votes in each players hand is counted and a round winner and runner-up are declared.

A further embodiment of the invention contemplates a teachers aid and method for teaching individuals about an election process. In this embodiment of the invention, a first individual an instructor, teacher or leader explains the fundamentals of the election process, the steps of registering to vote, casting a vote and tallying the number of votes cast. The teacher may also discuss the selection of candidates, verification process and perhaps a recount with the elimination of fraudulent votes.

The teacher then distributes the cards as for example by dealing nine cards each to three to five players and explaining the rules of the game as set forth in the aforementioned steps. Then during the play the teacher might point out that each round is analogous to a state or region in a national election. The teacher would also point out that the different value of the numerical value cards is analogous to the difference between small towns and relatively large cities.

The change card may also be used to explain how a candidate tries to carry his or her message to the voters and may actually lose some votes by emphasizing certain programs. Nevertheless the purpose of the change card is to gain more votes then the number lost.

The invention will now be described in connection with the following drawings.

DETAILED DESCRIPTION OF THE PREFERRED EMBODIMENTS OF THE INVENTION

Figure 1:
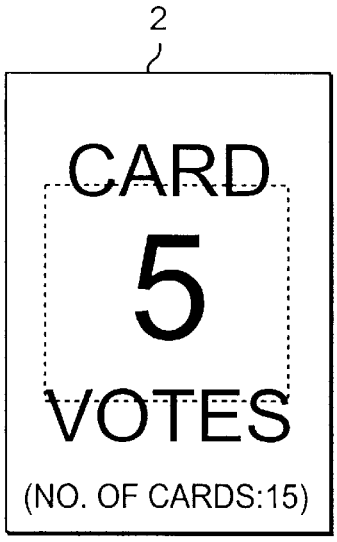
FIGS. 1–10 illustrate a plurality of numerical value cards having different numbers of votes and the number of such cards in a preferred embodiment of the invention.
Figure 2:
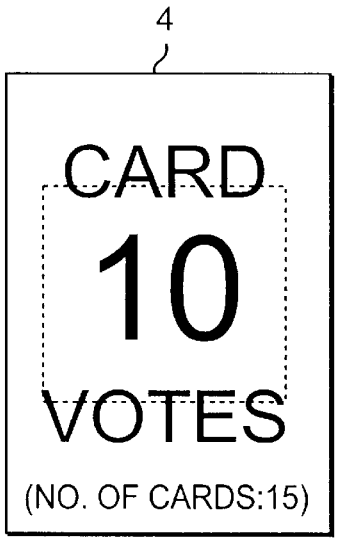
Figure 3:
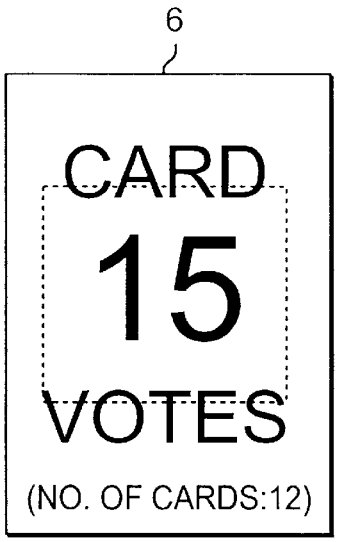
Figure 4:
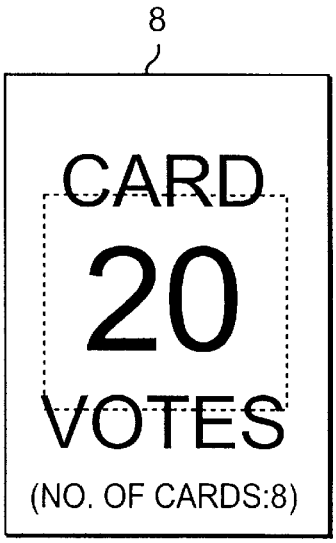
Figure 5:
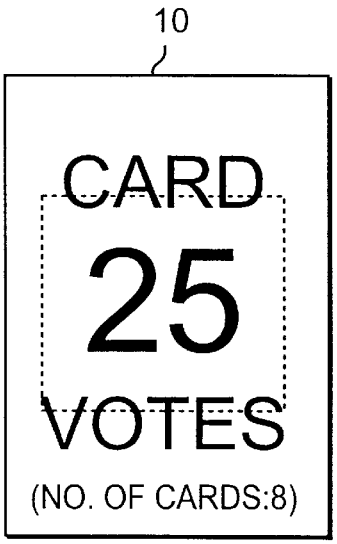
Figure 6:
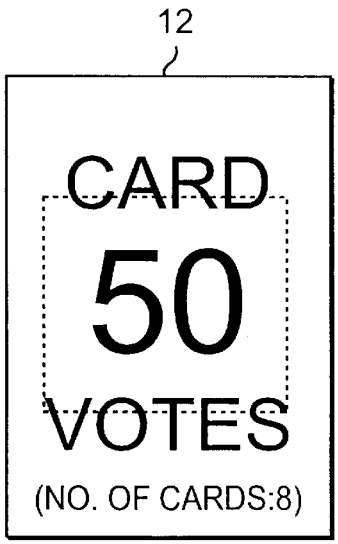
Figure 7:
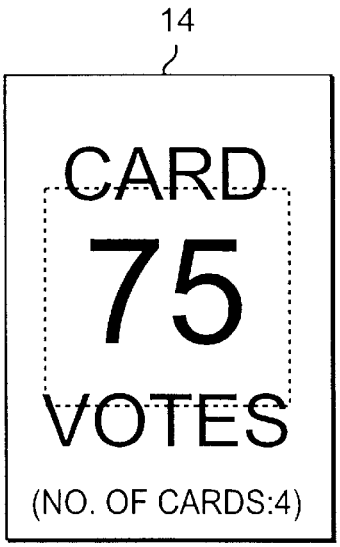
Figure 8:
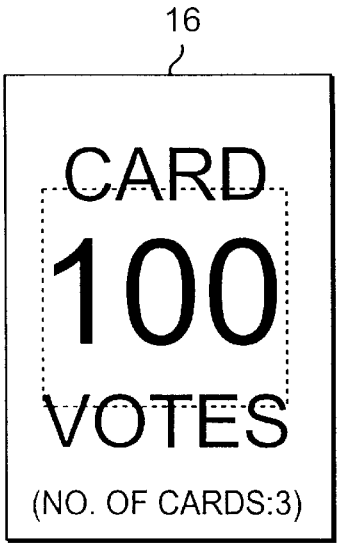
Figure 9:
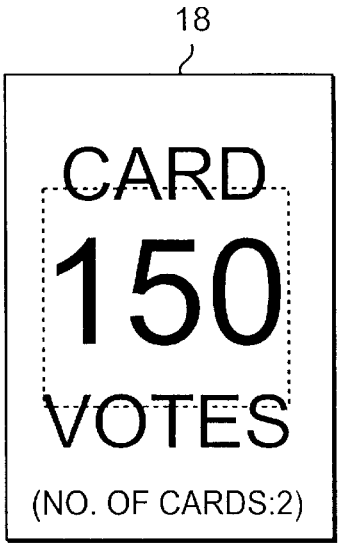
Figure 10:
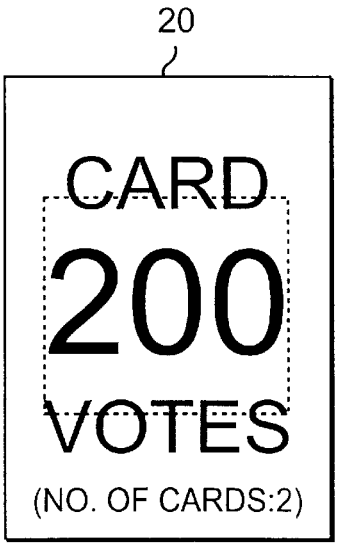
Figure 11:
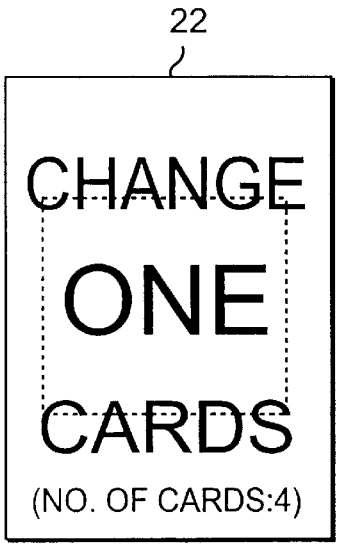
FIGS. 11–14 illustrate a plurality of specialized cards which allow a player to discard one or more cards and to draw the same number of cards from the draw pile and the number of each of such cards in a preferred embodiment of the invention.
Figure 12:
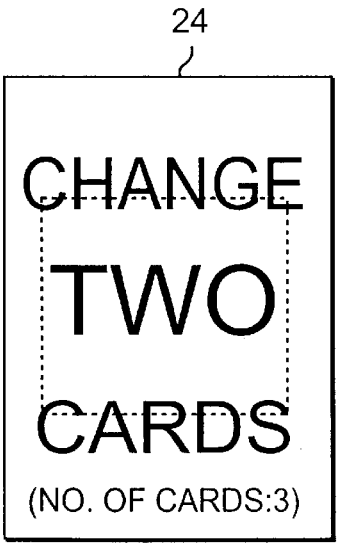
Figure 13:
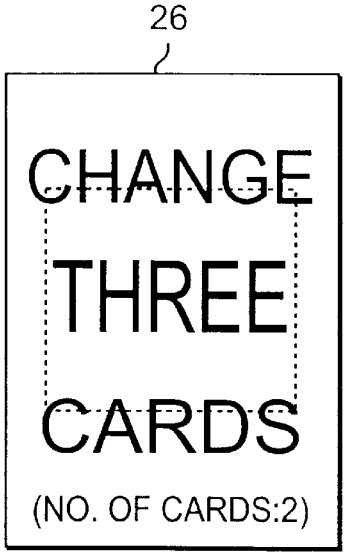
Figure 14:
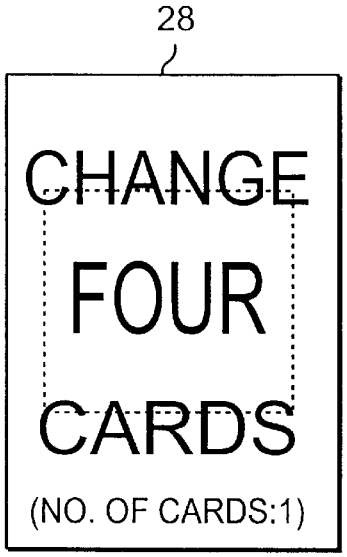
Figure 15:
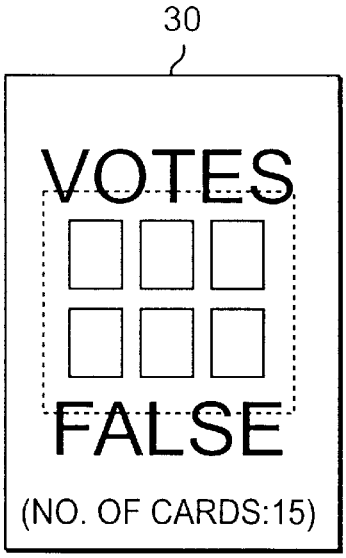
FIG. 15 illustrates a false vote card which has no numerical value and the number of such cards in a preferred embodiment of the invention.
Figure 16:
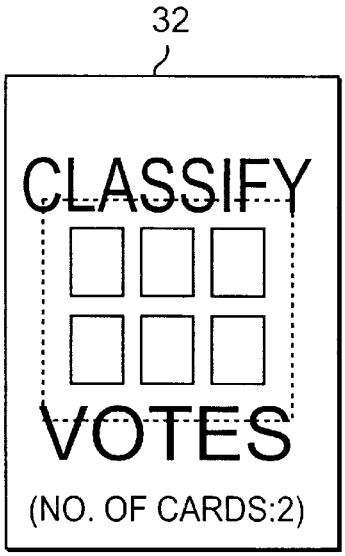
FIG. 16 illustrates a game ending card and the number of such cards in a preferred embodiment of the invention.

A preferred embodiment of the invention incorporates 104 cards as illustrated n the FIGS. For example, FIGS. 1–10 illustrate a series of numerical value cards 2, 4, 6, 8, 10, 12, 14, 16, 18, and 20. For example, the deck of cards includes fifteen cards 2 each of which has a numerical value of five votes. An additional fifteen cards 4 each of which has a value of ten votes are also included. In addition the deck includes twelve cards 6 having a value of fifteen votes.

The deck of cards in accordance with a preferred embodiment of the invention also includes eight cards 8 which have a value of twenty votes, eight cards 10 having a value of twenty-five votes and eight cards 12 with a value of fifty votes. In addition, the deck of cards includes four cards 14 with a value of seventy-five votes, three cards 16 with a value of one hundred votes, two cards 18 with a value of one hundred fifty votes and two cards 20 with a value of two hundred votes.

In addition to numerical value cards, a deck of cards in accordance with a preferred embodiment of the invention includes a number of special cards as shown in FIGS. 11–16. The special cards include four change cards 22 which allow a player to exchange a single card, three exchange cards 24 which allow a player to exchange two cards, two exchange cards 26 which allow a player to exchange three cards and one exchange card 28 which allows a player to exchange four cards as will be described in connection with the method of playing the election process game.

Figure 17:
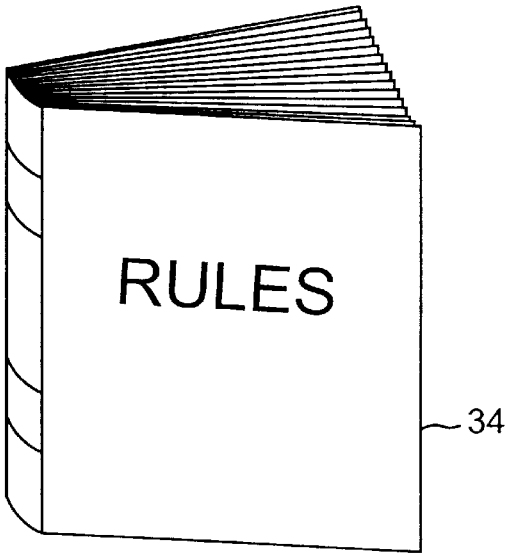
FIG. 17 illustrates a rule book for use in practicing the invention.

In the preferred embodiment of the invention, the deck of cards also includes fifteen false or fraudulent vote cards, 30 which have no numerical value and two classified vote or game ending or round ending cards 32. The deck of cards which may be used as a teachers aid also includes a set of rules or rule book 34 as shown in FIG. 17.

The election process or election boxes card game is played in accordance with the following rules. To begin, the game is most appropriate for three to five players and may include one or more rounds where players compete for the highest number of votes. As a general rule, it is recommended that the players complete seven or more rounds however, a game can be completed with any predetermined number of rounds. The players compete for the highest number of votes in each round, but it is the highest cumulative numbers which will determine the ultimate winner and the first runner-up.

To begin play one or more of the players shuffle the cards and an individual is selected to deal. This selection may be made by each player drawing a single card and the player drawing the highest card becomes the dealer. The dealer then deals nine cards face down to each of the players in a conventional manner. The remaining cards are placed face down to form a draw pile. The player to the right of the dealer may start the game in which case play will proceed in a counterclockwise direction. In the alternative the player to the dealer's left may begin play and then play will continue in a sequentially clockwise direction.

The player to one side of the dealer begins a play by discarding a card from his or her hand and then drawing one card from the draw pile. In discarding, the player places the card face down on a discard pile or next to his place. Each player may maintain their own discard pile or a central pile can be formed as long as it is clearly separated from the draw pile. Play then goes on wherein each player at each turn follows the same procedure.

When used as a teaching aid an instructor will begin play by explaining the voting process and the rules of the game. For example the instructor may use each round as a result of a vote from a specific state or region and explain the importance of regional or state votes for regional or state offices. The instructor would of course explain that the cumulative votes are analogous to a national election.

A player who is dealt or draws a change card can use the change card to get rid of "no vote" cards or cards with low numerical values. For example, if a player wants to exchange it for a number of cards as stated on one exchange card, the player waits for one's turn, draws a card and keeps it he or she then drops the exchange card face-side up puts down or discards the number of cards indicated and draws the same number of replacement cards.

The use of the exchange cards are thought to add excitement to the game by giving a player an opportunity to rid his hand of no vote or low vote cards and at the same time to gather additional votes. Such cards also provide an opportunity for a further explanation of the voting process. For example a teacher instructor might explain how a candidate may enter a new area such as a state or perhaps emphasize a number of different goals in an effort to attract additional votes. Nevertheless, by doing so, a candidate may actually lose votes as is possible when playing an exchange card. Obviously a player wants to eliminate any cards including an exchange card which have no numerical value.

The rules also provide that a player may only use one exchange card during a single term. If, for example, a player has a second exchange card, he or she will have to wait until their next turn to use it. The rules also limit the use of any one exchange card to one time during each round of play. The rules further provide that a player may not use an exchange card during the first round of play.

One of the game ending cards or classified cards 32 is used to end a round and once again a player holding this card waits for their turn, draws a card and discards the game ending card face up to end the round. This card is played when a player believes that they have accumulated the most number of votes as for example, after discarding all of their no votes or low value cards. The play is analogous to a prime minister calling for a vote even before his term expires or the end of a voting period.

In a preferred embodiment of an invention the player to the right of the one who ended the round starts by classifying their cards in front of the other players. However if play has proceeded in a clockwise direction, the player to the left would start the classifying process. What the player does is to sort their cards in order of their numerical value and the number of votes in their hand is recorded. When this is done, for the seventh or other preselected rounds the cumulative values for each player are counted and the winner and first runner up announced.

Another advantage of the election process card game is that with relatively young players, it is likely that they will have won or been runner up in one or two rounds which give them the satisfaction of playing a winning hand. It may also be pointed out that this is analogous to winning a state or regional election with a further explanation of the political process.

In a preferred embodiment of the invention, the classify cards 32, exchange cards 22, 24, 26 and 29, and false vote cards 30 have no numerical value. However the false vote cards 30 may be used to explain the problem of fraudulent votes or votes that may be thrown out due to some technicality.

FIG. 17 illustrates a set of rules 34 which regulate play as described above.

While the invention as been described in connection with its preferred embodiments, it should be recognized that changes and modifications may be made therein without departing from the scope of the appended claims.

What is claimed is:

1. A method for playing a card game wherein the card game includes a series a numerical value cards and special cards including at least one game ending card and one change card indicating a number of cards to be exchanged and wherein the numerical value cards correspond to a number of votes in an election, said method comprising the steps of dealing a predetermined number of cards to each of a plurality of players, forming a draw pile of all remaining cards, starting a discard pile by the discard of a card face down by respective players discarding one card at a time as their playing turn comes around and thereafter drawing a replacement card from the draw pile of cards, playing a change card during a players normal turn and discarding the change card, the number of cards indicated on the change card and drawing a replacement card for each of the cards discarded pursuant to the number indicated on the change card, discarding the game ending card by a player as their playing turn comes around to thereby end a round of play and counting the number of votes indicated on the numerical value card in each players hand to thereby determine which player holds the most votes to win the round.

2. The method of playing a card game according to claim 1 which includes the step of including a plurality of false vote cards which have no value.

3. The method of playing a card game according to claim 2 in which the numerical cards are discarded face down.

4. The method of playing a card game according to claim 3 in which the steps of claim 3 are repeated and in which the numerical values for each player for each round are recorded, the winner is the player with the most cumulative votes, and the runner up is the player with the next number of cumulative votes.

5. The method for playing a card game according to claim 4 which includes the step of providing numerical value cards in increments which are divisible by five for facilitating score keeping.

6. The method for playing a card game according to claim 5 in which said numerical value cards include cards in which the values are divisible by ten, twenty-five, fifty, or one hundred.

7. The method for playing a card game according to claim 5 which includes the step of providing a plurality of change cards and wherein the exchange cards provide for the exchange of a different number of cards.

8. The method for playing a card game according to claim 7 which includes the step of providing more than one game ending card.

9. The method for teaching individuals about an election process comprising the steps of:

providing a series of numerical value cards wherein each of the numerical values correspond to a number of votes in an election process and a plurality of special cards including an exchange card indicating a number of cards to be exchanged, a false vote card, a game ending card, and a set of rules;

explaining the rules of the game with analogies to an election process;

dealing a predetermined number of cards to each player and forming a draw pile with the remaining cards;

proceeding sequentially through a number of turns wherein each player draws a card from the draw pile and discards a card from their hand in an effort to obtain the highest number of votes;

playing an exchange card by discarding a number of cards indicated on the exchange card and drawing the same number of cards as replacements from the draw pile in an effort to increase the number of votes in ones hands;

explaining the exchange of votes with an analogy to a real life voting process;

playing the game ending card thereby end a round of play with a further explanation of how a real life voting process ends or how an election process is initiated; and counting the votes with an explanation of the false vote cards and declaring a winner and first runner up based on the number of votes accumulated.

10. The method for teaching individuals about the election process according to claim 9 which includes a number of rounds of play with an explanation of various regions voting in an election.

* * * * *